United States Patent [19]

Bauer

[11] 4,056,799

[45] Nov. 1, 1977

[54] HOUSING FOR SECURING A DAMPING COMPRESSION SPRING IN AN ELECTROMAGNETIC SWITCHING APPARATUS

[75] Inventor: Johann Bauer, Amberg, Germany

[73] Assignee: Siemens Aktiengesellschaft, Berlin and Munich, Germany

[21] Appl. No.: 637,403

[22] Filed: Dec. 3, 1975

[30] Foreign Application Priority Data

Dec. 5, 1974 Germany ..... 2457608

[51] Int. Cl.[2] ..... H01F 7/08

[52] U.S. Cl. ..... 335/277; 335/257

[58] Field of Search ..... 335/277, 250, 132, 157, 335/158, 271, 278, 257, 247, 248

[56] References Cited

U.S. PATENT DOCUMENTS

| | | | |
|---|---|---|---|
| 3,305,808 | 2/1967 | Widl | 335/250 |
| 3,878,491 | 4/1975 | Rauter et al. | 335/277 |
| 3,902,144 | 8/1975 | Fischer | 335/277 |
| 3,942,143 | 3/1976 | Pollmann et al. | 335/132 |
| 3,964,006 | 6/1976 | Lacan | 335/132 |
| 3,970,977 | 7/1975 | Weissberger | 335/277 |

*Primary Examiner*—Harold Broome

*Attorney, Agent, or Firm*—Kenyon & Kenyon, Reilly, Carr & Chapin

[57] ABSTRACT

In the housing of an electromagnetic switching apparatus including a magnet coil and switching and non-switching magnet parts disposed within the housing, and at least one damping compression spring for biasing the non-switching magnet part in one direction in the housing, the spring having a plurality of turns of the same diameter and one end turn having a diameter greater than that of the plurality of turns for securing the spring in the housing, the improvement comprising hook-shaped projection members disposed within the housing about the periphery of the compression spring. The projection members are spaced apart from each other along a diameter of the spring by a distance which is greater than the diameter of the plurality of turns thereof but less than the diameter of the end turn. The plurality of turns of the spring are axially movable between the projection members while the end turn of the spring is engaged by the members. The compression spring is thus axially movably secured in the housing of the switching apparatus.

8 Claims, 4 Drawing Figures

HOUSING FOR SECURING A DAMPING COMPRESSION SPRING IN AN ELECTROMAGNETIC SWITCHING APPARATUS

BACKGROUND OF THE INVENTION

1. Field of the Invention

This invention relates generally to electromagnetic switching apparatus, and in particular to an improved housing for such an apparatus including means for axially movably securing a damping compression spring therein.

2. Description of the Prior Art

Damping compression springs having enlarged end turns, i.e., an end turn having a diameter greater than the other turns of the spring, for securing the spring in the housing of an electromagnetic switching apparatus are generally known in the art. In one known compression spring of the type described above, the end turn has a diameter which is only slightly greater than the other turns of the spring so that the latter can be inserted beyond the outlined dimension of the spring into a blind hole having a diameter chosen so that the enlarged end turn engages the interior surface of the blind hole and the spring is retained therewithin by the spring force of the enlarged end turn. A typical arrangement of this type is a back-pressure spring which is retained in the blind hole of a contact bridge carrier. The disadvantage of such an arrangement, however, is that free movement of the spring along its axis does not exist.

SUMMARY OF THE INVENTION

It is therefore an object of the present invention to overcome the aforementioned disadvantages of prior art compression spring arrangements, and to provide an improved housing and compression spring design for securing the compression spring within the housing of an electromagnetic switching apparatus which is reliable in operation, simple in construction, and easy to handle.

These and other objects of the invention are achieved in an electromagnetic switching apparatus of the type including a housing, a magnet coil and switching and non-switching magnet parts disposed within the housing, and at least one damping compression coil spring for biasing the non-switching magnet in one direction in the housing. The spring has a plurality of turns of the same diameter, and includes an end turn having a diameter which is greater than that of plurality of turns for securing the spring within the housing. The improvement of the invention comprises the provision of hook-shaped projection members in the housing disposed about the periphery of the compression spring. The projection members are spaced apart from each other along a diameter of the compression spring by a distance which is greater than the diameter of the plurality of turns of the spring but is less than the diameter of the end turn thereof. The plurality of turns of the spring are movable axially between the members, but the end turn thereof engages the projection members so as to axially movably secure the spring in the housing of the apparatus. In other words, the enlarged end turn of the spring is inserted behind the hook-shaped projection members of the housing and engages the members to secure the spring therewithin, but the plurality of turns comprising the major portion thereof are freely movable between the projection members along the axis of the spring.

The projection members are preferably shaped as annular segments and are preferably supported by support members in the housing which are spaced apart by a distance greater than the diameter of the end turn so that the latter is freely movable therebetween. Good guidance of the spring in the axial direction between the projection members is thereby obtained. Also, the projection members are preferably disposed in opposing relationship with respect to each other and are separated by a distance along the circumference of the end turn thereof which is sufficient to permit the insertion therebetween of the plunger of a spring insertion tool. Simple and easy insertion of the spring in the housing is thereby facilitated.

It is also advantageous if the spring is disposed within the housing so that the enlarged end turn thereof engages one or more parts of the non-switching, i.e., stationary, part of the magnet of the apparatus. This enables the switching apparatus to be fabricated so as to include one module for the upper part and lower part thereof, and allows disassembly of the switching apparatus for changing the coils of the apparatus. The coil spring is preferably disposed in engagement with a planar member, such as a latch, which extends through the non-switching magnet part of the apparatus to eliminate any projections at the latter part of the magnet. The magnet coil of the apparatus may also be provided with a guide post over which the end of the compression spring opposite the enlarged end turn is disposed. The lateral position of the spring within the housing is thereby fixed and contact between the spring and the hook-shaped projection members during operation of the apparatus is prevented. Such a guide post preferably has a conical shape to facilitate reception of the coil spring thereover.

Insertion of a coil spring of the above-described type in a housing including such projection members can be achieved automatically in a simple manner by utilizing a coil spring insertion tool comprising a hollow cylindrical plunger member including a recess having a diameter greater than the diameter of the plurality of turns of the spring for receiving the spring and including on one end face thereof a pair of projection members spaced apart by a distance which is greater than the diameter of the plurality of the turns of the spring but less than the diameter of the end turn thereof so as to engage the latter. A magnet is preferably disposed within the recess of the plunger member at one end thereof, i.e., the bottom or closed end of the recess, in order to magnetically attract the compression spring and retain the spring in the plunger member in a secure manner during insertion thereof into the apparatus housing.

These and other novel features of the invention disclosed herein will be described in further detail in the following detailed description.

BRIEF DESCRIPTION OF THE DRAWINGS

In the drawings, wherein similar reference numerals denote similar elements throughout the several views thereof.

DETAILED DESCRIPTION

Figure 1:
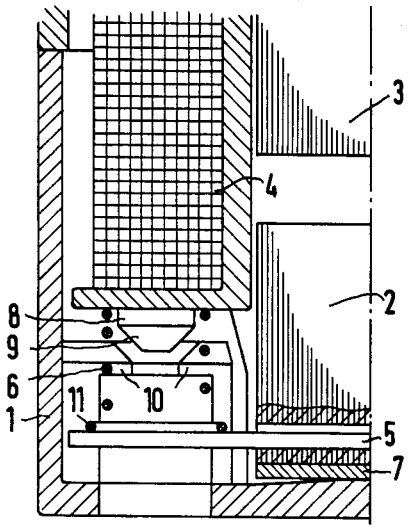
FIG. 1 is a partial, cross-sectional side view of an electromagnetic switching apparatus including a housing constructed according to the present invention.
Figure 2:
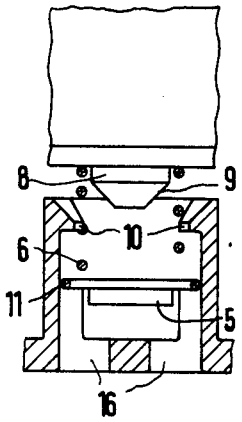
FIG. 2 is a partial, cross-sectional end view of the housing shown in FIG. 1.

Referring now to the drawings, and in particular to FIGS. 1 and 2, there is shown an electromagnetic switching apparatus including a magnet chamber part 1 forming the lower portion of the housing of the apparatus. A non-switching magnet part 2, a switching magnet part 3, and a magnet coil 4 are disposed within the housing. The non-switching part 2 is biased by means of a latch member 5 and a pair of damping compression springs 6 (only one of which is visible in the drawings) in a direction towards the bottom of the housing and magnet chamber part 1. An insert member 7 is disposed between the non-switching magnet part 2 and the bottom of the magnet chamber. Springs 6 are disposed within the housing so that one end thereof engages latch member 5; the other end of the springs engages magnet coil 4 which is mounted stationary in the housing. A guide post 8 is mounted on the bottom surface of magnet coil 4 and includes a conically-shaped end portion 9 which guides the end of spring 6 thereover during assembly of the switching apparatus.

A pair of hook-shaped projection members are integrally formed with housing part 1 and are disposed about the periphery of spring 6. Each spring comprises a plurality of turns having a diameter which is less than that of an enlarged end turn 11 disposed at one end thereof. In other words, when compared to the plurality of turns of the spring, the enlarged turn 11 has a diameter which enables it to lie over the outer circumference of the spring if the latter is compressed. The projection members are spaced apart from each other along a diameter of spring 6 by a distance which is greater than the diameter of the plurality of turns but less than the diameter of the end turn 11 thereof. The projection members 10 thus do not engage the plurality of turns of spring 6, but do engage the end turn 11, with the result that spring 6 is freely axially movable between the projection members along the axis of the spring. Wear of the housing during the operation of the switching apparatus is thereby eliminated. The projections 10 are also integrally formed with support members which are spaced apart from each other by a distance which is greater than the diameter of the enlarged end turn 11 of the spring so that the latter is also freely axially movable within the magnet chamber part 1. The projection members 10 are shaped as annular segments (FIG. 4) and are preferably provided with a conically bevelled surface on the side thereof facing the direction from which the spring is inserted into the housing, i.e., facing the magnet coil 4 in the housing, to facilitate insertion of the spring between the projection members 10.

Figure 4:
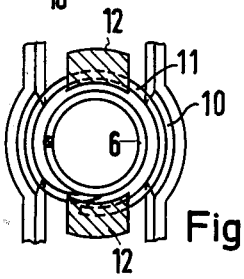
FIG. 4 is a cross-sectional view through the end of the spring insertion tool taken along section IV—IV of FIG. 3.

As illustrated in FIG. 4, the hook-shaped projection members 10 are disposed opposite each other and have the end portions thereof spaced apart along the circumference of the end turn 11 of the spring by a distance which permits the insertion of a spring insertion tool comprising a cylindrical hollow plunger member 14 having a recess for receiving spring 6. The recess of the tool has a diameter which is greater than that of the plurality of turns of the spring, and the plunger member has downwardly extending projection members 12 disposed on the end face 13 thereof which are spaced apart by a distance greater than the diameter of the plurality of turns of the spring but less than the diameter of the end turn 11 of the spring. Members 12 engage the end turn and forceably push it downwardly along the bevelled surface of projection members 10 and behind the latter within the housing. A magnet 15 is preferably disposed within the recess of the plunger member for magnetically attracting the coil spring and retaining the latter therein during insertion into the housing.

Figure 3:
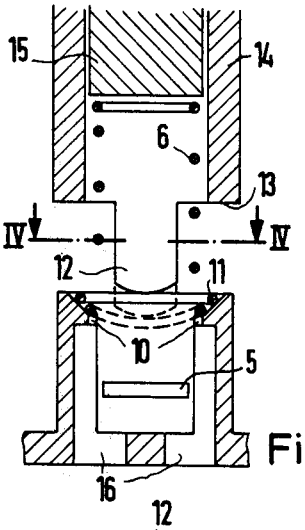
FIG. 3 is a cross-sectional view of a compression spring insertion tool constructed according to the invention, showing the compression spring disposed in the tool during insertion thereof into the switching apparatus housing and the end turn of the spring behind the hook-shaped projection members of the housing.

As shown in FIG. 3, insertion of the coil spring into the housing of the apparatus is achieved by moving the plunger with the spring in the recess thereof towards the hook-shaped projection members 10. The turn 11 is then forced downwardly along the bevelled end face of projections 10 and is bent, as indicated by the dashed lines in the figure, downwardly until it slips through the space between the projection members and snaps behind the latter. The projection members need not be elastic in nature, and can be formed or pressed on in a simple manner during fabrication of the magnet chamber housing part 1 without the need for cross slides for the casting or molding form, since openings 16 in the bottom of housing part 1 are provided.

The above-described arrangement assures a secure attachment of the coil spring in the magnet chamber housing part 1 but permits the spring to move freely axially within the housing so that wear at the housing is eliminated and the mounting support thereof is preserved if the switching apparatus housing is opened after it has been placed in operation for a period of time. In addition, by arranging the end turn 11 of the coil spring behind the projection members 10 of the housing, the non-switching magnet part 2, the latch member 5 and the magnet chamber housing part 1 may be combined in a single module.

In the foregoing, the invention has been described with reference to specific exemplary embodiments thereof. It will, however, be evident that various modifications and changes may be made thereunto without departing from the broader spirit and scope of the invention as set forth in the appended claims. The specification and drawings are, accordingly, to be regarded in an illustrative rather than in a restrictive sense.

What is claimed is:

1. In an electromagnetic switching apparatus including a housing, a magnet coil and switching and non-switching magnet parts disposed within said housing, and at least one damping compression coil spring for biasig said non-switching magnet part in one direction in said housing, said spring having a plurality of turns of the same diameter, and an end turn having a diameter which is greater than that of said plurality of turns for securing said spring within said housing, the improvement comprising said housing including hook-shaped projection members disposed about the periphery of said spring, said projection members being spaced apart from each other along a diameter of said spring by a distance which is greater than the diameter of said plurality of turns but less than the diameter of said end turn so that said plurality of turns are movable axially between said members and said end turn engages said members for movably securing said spring in said housing.

2. The apparatus recited in claim 1, wherein said hook-shaped projection members comprise annular segments and are disposed on support members provided in said housing, said support members being spaced apart by a distance which is greater than the diameter of said end turn of said spring so that said spring is movable axially between said support members.

3. The apparatus recited in claim 2, wherein said hook-shaped projection members are disposed in opposing relationship with respect to each other and have the respective end portions thereof spaced apart by a distance along the circumference of said end turn of said spring which is sufficient to permit the insertion therebetween of the plunger of a spring insertion tool.

4. The apparatus recited in claim 1, wherein said non-switching magnet part includes a planar member extending outwardly therefrom adjacent one end of said spring, said spring being disposed between said planar member and a surface of said magnet coil, with said end turn of said spring being disposed in engagement with said planar member.

5. The apparatus recited in claim 4, wherein said planar member comprises a latch extending through said non-switching magnet part.

6. The apparatus recited in claim 4, wherein said magnet coil includes a guide post disposed on the surface thereof which engages said spring, the end of said spring opposite said end turn thereof being disposed over said guide post and in engagement with said magnet coil.

7. An apparatus for inserting a damping compression coil spring in the housing of an electromagnetic switching apparatus, said spring having a plurality of turns of the same diameter, and an end turn having a diameter which is greater than that of said plurality of turns for securing said spring within said housing, and said housing including hook-shaped projection members disposed about the periphery of said spring and being spaced apart from each other along a diameter of said spring by a distance which is greater than the diameter of said plurality of turns but less than the diameter of said end turn so that said plurality of turns are movable axially between said projection members and said end turn engages said members for movably securing said spring in said housing, said apparatus for inserting said spring in said housing comprising:

a hollow cylindrical plunger member, including a recess having a diameter greater than the diameter of said plurality of turns of said spring, for receiving said compression spring; and at least two outwardly extending projection members, coupled to one end of said plunger member, and spaced apart on one end face thereof by a distance which is greater than the diameter of said plurality of turns but less than the diameter of said end turn, for engaging said end turn of said spring.

8. The spring insertion apparatus recited in claim 7, further comprising a magnetic member, disposed within said recess of said plunger member at one end thereof, for magnetically attracting said spring and retaining said spring within said recess.

* * * * *